United States Patent [19]

Smith et al.

[11] Patent Number: 4,884,477

[45] Date of Patent: Dec. 5, 1989

[54] ROTARY DRILL BIT WITH ABRASION AND EROSION RESISTANT FACING

[75] Inventors: Redd H. Smith, Salt Lake City; Craig H. Cooley, Bountiful, both of Utah

[73] Assignee: Eastman Christensen Company, Salt Lake City, Utah

[21] Appl. No.: 175,926

[22] Filed: Mar. 31, 1988

[51] Int. Cl.[4] ..... B22F 7/04

[52] U.S. Cl. ..... 76/108 A; 419/9; 419/37; 76/DIG. 11; 76/DIG. 12; 428/547; 428/610

[58] Field of Search ..... 76/108 A, 108 R, 101 R, 76/101 E, DIG. 11; 419/9, 37; 428/547, 610; 164/80

[56] References Cited

U.S. PATENT DOCUMENTS

| | | | |
|---|---|---|---|
| 3,757,878 | 9/1973 | Wilder et al. . | |
| 3,757,879 | 9/1973 | Wilder et al. . | |
| 3,885,637 | 5/1975 | Veprintsey | 76/108 R |
| 4,173,457 | 11/1979 | Smith . | |
| 4,398,952 | 8/1983 | Drake | 419/18 |
| 4,460,053 | 7/1984 | Jurgens . | |
| 4,499,795 | 2/1985 | Radtke | 76/108 A |
| 4,527,642 | 7/1985 | Knowltes . | |
| 4,610,320 | 9/1986 | Beakley | 419/9 |
| 4,624,830 | 11/1986 | Barr | 419/7 |
| 4,720,371 | 1/1988 | Shirley | 419/10 |
| 4,793,968 | 12/1988 | Mosser | 419/18 |
| 4,797,251 | 1/1989 | Sakuramoto | 419/9 |

FOREIGN PATENT DOCUMENTS

| | | |
|---|---|---|
| 2151282 | 7/1985 | United Kingdom . |

*Primary Examiner*—Roscoe V. Parker

*Attorney, Agent, or Firm*—Joseph A. Walkowski

[57] ABSTRACT

A rotary drill bit is provided for boring earth formations which includes a bit blank and a metal matrix secured to the blank. The metal matrix includes a filler material dispersed therein. Cutting elements are mounted on the exterior face of the bit, and substantially all of the exposed internal and external surfaces of the bit are coated with an erosion and abrasion resistant hardfacing material bonded to the metal matrix.

41 Claims, 2 Drawing Sheets

ROTARY DRILL BIT WITH ABRASION AND EROSION RESISTANT FACING

BACKGROUND OF THE INVENTION

This invention relates to drill bits and methods of fabrication, and more particularly to drill bits having a hard abrasion and erosion resistant face and having cutters used in the rotary drilling of bore holes in earth formations.

Typically, earth boring drill bits include an integral bit body which may be of steel or may be fabricated of a hard matrix material such as tungsten carbide. A plurality of diamond or other "superhard" material cutting elements are mounted along the exterior face of the bit body. Each diamond cutting element typically has a backing portion which is mounted in a recess in the exterior face of the bit body. Depending upon the design of the bit body and the type of diamonds used (i.e., either natural or synthetic), the cutters are either positioned in a mold prior to formation of the bit body or are secured to the bit body after fabrication.

The cutting elements are positioned along the leading edges of the bit body so that as the bit body is rotated in its intended direction of use, the cutting elements engage and drill the earth formation. In use, tremendous forces are exerted on the cutting elements, particularly in the forward to rear tangential direction as the bit rotates, and in the axial direction of the bit. Additionally, the bit body and cutting elements are subjected to substantial abrasive and erosive forces.

Typically, the rotary bit includes a fluid flow passage through the interior of the bit which splits into a plurality of passages which are directed to the exterior surface of the bit. These passages, and the exit ports from which fluid is ejected are positioned about the exterior surface of the bit and are directed to impinge high velocity drilling fluid against or across the cutting elements to cool and clean them and to remove adhering cuttings therefrom. The fluid also aids in washing the cuttings from the earth formation upwardly to and through so-called junk slots in the bit to the surface. Again, the high velocity flow of drilling fluid in combination with the cuttings exert tremendous erosive forces on the exterior surfaces of the bit, which also experiences abrasion from contact with the formation being drilled.

Steel body bits have been used for certain earth formations because of their toughness and ductility properties. These properties render them resistant to cracking and failure due to the impact forces generated during drilling. However, steel is subject during drilling operations to rapid erosion from high velocity drilling fluids, and to abrasion from the formation. Typically, such steel body bits have been coated with a hard material such as tungsten carbide to improve erosion resistance. However, tungsten carbide and other erosion resistant materials tend to be brittle. Moreover, there may be thermal expansion mismatches which occur between the steel body and harder material during heat processing which can weaken the bond between the two. During use, the relatively thin coatings may tend to crack and peel, revealing the softer steel body which is then rapidly eroded and abraded. This leads to diamond cutter loss, as the area of the bit supporting the cutter is cut out, and eventual failure of the bit.

Tungsten carbide or other hard metal matrix bits have the advantage of high erosion and abrasion resistance. The matrix bit is generally formed by packing a graphite mold with tungsten carbide powder and then infiltrating the powder with a molten copper alloy binder. A steel blank is positioned in the mold and becomes secured to the matrix as the bit cools after furnacing. Also present in the mold is a mandrel which, when removed after furnacing, leaves behind the fluid passages through the bit. After molding and furnacing of the bit, the end of the steel blank can be welded or otherwise secured to an upper threaded body portion of the bit.

Such tungsten carbide or other hard metal matrix bits, however, are brittle and can crack upon being subjected to impact forces encountered during drilling. Additionally, thermal stresses from the heat applied during fabrication of the bit or during drilling may cause cracks to form. Finally, tungsten carbide and other erosion resistant materials are very expensive in comparison with steel as a material of fabrication.

The problem of fabricating a drill bit which has the desirable properties of toughness and ductility of a steel bit in combination with the erosion resistance of a hard metal matrix bit have been addressed in U. S. application Ser. No. 107,945, filed Oct. 13, 1987, and entitled EARTH BORING DRILL BIT WITH MATRIX DISPLACING MATERIAL. There, a rotary bit is fabricated using a hard metal matrix material which contains a displacement material such as steel powder or steel shot. The displacement material advantageously improves the toughness and ductility of the bit while displacing some of the more expensive hard metal matrix material with a less expensive material.

However, it has been found that bits produced with such displacement material are more subject to erosive and abrasive forces because of the presence of some portion of the displacement material at the exterior face of the bit. Accordingly, there is still a need in the art for a drill bit which has the toughness, ductility, and impact resistance of steel and the hardness as well as abrasion and erosion resistance of tungsten carbide or other hard metal material.

SUMMARY OF THE INVENTION

The present invention meets that need by providing a rotary drill bit and process of fabrication in which at least a portion of the tungsten carbide normally used in the metal matrix is replaced by a substitute filler material which, preferably, imparts a greater degree of toughness, ductility, and impact strength to the bit. The invention also provides a rotary bit in which at least some and preferably substantially all of the surfaces of the bit exposed to erosion and/or abrasion are coated with a layer of hard, abrasion and erosion resistant material, hereinafter termed "hardfacing" or a "hardface layer" or "coating" bonded to the inner matrix material. The resulting bit may be custom engineered to possess optimal characteristics for specific earth formations.

In accordance with one aspect of the present invention, a rotary drill bit is provided which includes a bit blank having a fluid passage therein and a metal matrix secured to the blank. The metal matrix includes a filler material having a different composition and lesser hardness than the tungsten carbide of the prior art matrix. The matrix further has a plurality of exit ports communicating between the fluid passage in the bit blank and the exterior face of the bit. The matrix also carries cutting elements mounted on the exterior face of the bit. Further, the bit has substantially all surfaces exposed to erosive fluid flow or abrasive contact with the formation coated with a layer of hardfacing material which is bonded to the inner metal matrix.

The filler material for the interior of the matrix is preferably in the form of a plurality of particles which can vary in size. Iron and steel particles are especially preferred because it has been found that these particles impart desirable properties to the matrix while being relatively inexpensive in comparison to the cost of tungsten carbide or other hard metal component of the matrix. Particles as small as about 400 mesh (approx. 0.001 inches) or as large as about 0.25 inches or larger may be utilized. Spherical or generally spherical particles are preferred because they will pack into a mold readily, although irregularly shaped particles may be employed.

Other filler materials which can be used in the practice of the present invention include other ferrous alloys such as iron-molybdenum and iron-nickel which impart increased toughness and ductility as well as enhanced thermal properties, to the matrix. Other metals which may be used as filler materials includes nickel, cobalt, manganese, chromium, vanadium, and alloys and mixtures thereof. Sand, quartz, silica, ceramic materials, and plastic coated minerals may also be utilized either in small particle sizes or agglomerated with binder to form larger particles.

In practice, the filler material may be any material which can withstand the 1000 degrees C. or greater processing temperatures encountered during the bit fabrication process and which is compatible with the hard metal matrix material and the binder. By withstanding the furnacing process, it is meant that the filler material may melt so long as it maintains its integrity, does not disperse in the matrix, and does not undergo excessive expansion or shrinkage during the heating-/cooling cycle.

While the filler material may be added in volumes as low as about 10% of total matrix volume to effect lesser changes in matrix characteristics, preferably, the displacement material is added in an amount of between about 50% to about 80% by volume of the total matrix volume. Use of different diameter spherical particles aids in obtaining optimum packing within the mold. By utilizing particles with both large and small diameters, the small diameter displacement material can pack into interstices between the larger diameter material.

The layer of hardfacing material which is bonded to the exterior face of the inner metal matrix material of the bit may itself be of a similar composition as the hard metal matrix material of the prior art. As is known in the art, the mix or combination of particle sizes in tungsten carbide powder, or other hard metal matrix powder, may be varied to produce a matrix having a greater or lesser degree of hardness. For example, a very fine grain tungsten carbide powder typically will produce a denser and harder matrix than a coarser grain powder. This hardness is based on the skeletal density of the matrix. For the facing of abrasion resistant material, it is preferred that it have a hardness greater than the material making up the metal matrix portion of the bit.

The thickness of the coating comprising the hardfacing on the matrix may vary from between about 0.01 inches to about 0.25 inches, with a thickness of between about 0.10 to about 0.20 inches being most preferred. The purpose of this hardface layer is to protect exposed surfaces of the metal matrix material from the erosive and abrasive forces encountered during drilling. The furnacing process in fabricating the bit in which a binder infiltrates both the inner matrix filler material and hardface layer causes the hardface layer to bond securely to the matrix and become an integral part thereof.

In accordance with the present invention, a rotary drill bit is fabricated so that substantially all exposed surfaces thereof are coated with a hardfacing material including the interior of the fluid passages through which drilling fluid flows during operation of the bit. The fabrication process includes the steps of forming a hollow mold for molding at least a portion of the drill bit. A bit blank and displacement parts, corresponding to exit ports to be formed within the bit, are then positioned interiorly of the mold. The displacement parts may define separate internal fluid passages or may be a unitary crowfoot-type design.

Adhesive is then applied to the interior surfaces of the mold and the exterior surfaces of the displacement parts, followed by the application of the hardfacing material to the adhesively-coated surfaces of the mold and the displacement parts. The adhesive is effective to hold the hardfacing material in place at the surface of the mold. A number of sequential applications of adhesive and hardfacing material may be applied to build up the thickness of the layer. In a preferred embodiment, the composition of the hardfacing material may be varied from application to application across the thickness of the layer to gradually add filler material to the hardfacing material. In another embodiment, successive applications of hardfacing material and filler may be alternated to provide a transition between the hardface layer and the matrix. Both embodiments provide a layer having an improved match of coefficients of expansion with the inner matrix and filler material. This reduces thermal stresses during heat processing and cooling of the bit. Moreover, this technique may be utilized to include binder or other metal materials in the layer.

The mold is then packed with a metal matrix material including a filler material, and the metal matrix material and the hardfacing material are infiltrated with a binder in a furnace to form the bit. The displacement parts are then removed to form fluid passages having the erosion resistant hardface layer on the exposed surfaces thereof.

With the practice of the present invention, a less expensive displacement material may be substituted for more expensive hard metals like tungsten carbide with no adverse effect on the overall strength properties of the finished bit. In fact, the use of iron, steel, or alloys thereof as the filler material provides a finished bit with improved toughness and ductility as well as impact strength. Furthermore, the use of a coating of a hardfacing material on substantially all of the exposed surfaces of the bit provides good erosion and abrasion resistance while maintaining desired levels of toughness, ductility, and impact strength. Variation of the composition across the thickness of the hardface coating material reduces the residual stresses at the interface between matrix and hardfacing.

Accordingly, it is an object of the present invention to provide a rotary drill bit in which substantially all exposed surfaces thereof are coated with a hardfacing material. It is a further object of the present invention to provide a rotary drill bit having improved toughness, ductility, impact strength and lower cost over prior hard metal matrix bits. These, and other objects and advantages of the present invention, will become apparent from the following detailed description, the accompanying drawings, and the appended claims.

DESCRIPTION OF THE PREFERRED EMBODIMENTS

Figure 1:
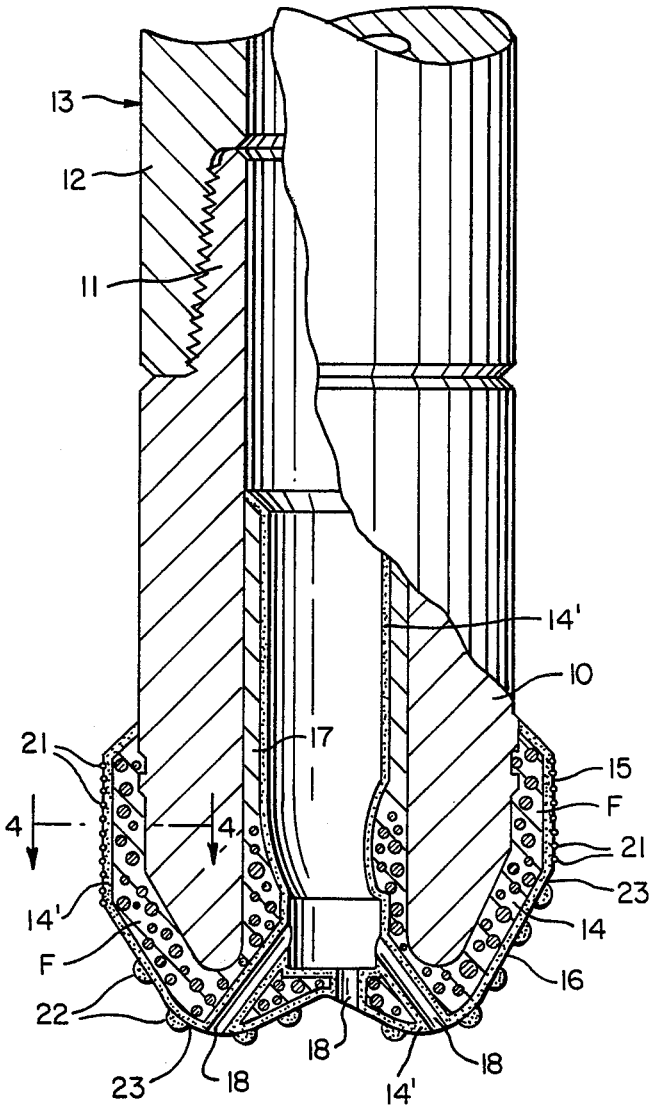
FIG. 1 is a view, partly in section and partly in elevation, of a rotary drill bit made in accordance with the present invention.

The invention is illustrated in the drawings with reference to a typical construction of a rotary earth boring bit. It will be recognized by those skilled in this art that the configuration of the cutting elements along the exterior face of the matrix may be varied depending upon the desired end use of the bit. Additionally, while the invention has been illustrated in conjunction with a full bore rotary matrix bit, it will be appreciated by those skilled in this art that the invention is also applicable to core head type bits for taking core samples of an earth formation.

Referring now to FIG. 1, the rotary drill bit includes a tubular steel blank having blades 10 extending from the lower end thereof welded to an upper pin 11 (weld line not shown) threadedly secured to a companion box 12 forming the lower end of the drill string 13. A matrix 14 of metal matrix material, such as metal bonded tungsten carbide, has an upper gage section 15 which merges into a face portion 16 extending across the tubular blank 10. Matrix 14 is integral with an inner portion 17 disposed within and around the blank.

Filler material F is shown in the form of relatively large diameter spherical particles interspersed throughout the matrix. It will be understood that filler material F can assume a variety of forms including both solid and hollow spheres, cylinders, lengths of wire, as well as irregular shapes. Hardfacing material 14' is coated over the exterior surfaces of both the inner metal matrix 14 as well as fluid passages 18. Hardfacing material 14' is preferably a hard metal or other material such a tungsten carbide, boron nitride or silicon carbide. The particle sizes of the hardfacing material are chosen to provide a dense structure which is harder than the metal matrix material 14. Generally, the use of fine grain sizes provide a denser and harder coating structure.

As shown, hardface coating 14' is bonded to inner metal matrix 14 and has a thickness of between about 0.01 to 0.25 inches, and most preferably about 0.10 to about 0.20 inches. This thickness is believed to provide adequate protection from erosive and abrasive forces to the underlying metal matrix and filler material combination. As will be explained in further detail below, the same binder which is used to infiltrate metal matrix also infiltrates and bonds the hardface layer 14' to the bit body.

Figure 4:
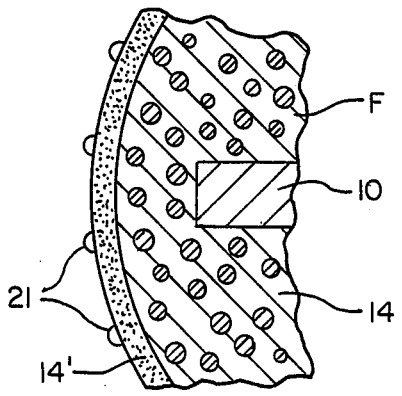
FIG. 4 is a cross-sectional view of the matrix portion of a rotary drill bit of the present invention taken along line 4—4 of FIG. 1 illustrating the coating of hardface material on the face thereof.

As best shown by FIG. 4, this hardface layer 14' bonds to the filler material F and metal of matrix 14 to form a protective layer for the exposed surfaces of the bit. FIG. 4 illustrates a typical cross section of a portion of a rotary bit fabricated in accordance with the present invention.

As is conventional, fluid pumped downwardly through the drill string and into the tubular blank can flow into the inner matrix portion 17, discharging through a plurality of exit ports 18 into the bottom of the bore hole. This fluid carries the cuttings from the drill bit in a laterally outward direction across the face of the bit and upwardly through a plurality of spaced vertical passages or junk slots (not shown). Because the walls of the exit ports 18 are coated with hardfacing 14', these surfaces are able to better withstand the erosive forces of the high velocity drilling fluid which passes therethrough. Additionally, the coating of hardfacing 14' across substantially the entire exposed exterior surface of the rotary bit enables those surfaces to better withstand the erosive and abrasive forces caused by the high velocity flow of cuttings across the face of the bit and contact with the formation.

The junk slots for removal of the cuttings are conventionally located in the gauge section of the bit and convey the cuttings and drilling fluid into the annulus surrounding the tubular blank 10 and the drill string 13 and from there to the top of the bore hole. Such junk slots are conventional in the art. Diamond cutting elements 21 may be optionally embedded in the stabilizer or gauge section 15 of the bit to reduce wear on the latter section of the matrix.

Cutting elements 22 are disposed in sockets 23 in matrix 14 and 14' and may be arranged in any desired conventional pattern which will be effective to perform the cutting action. Depending upon the type of diamonds utilized, sockets 23 may be preformed in the matrix during fabrication. If sockets 23 are preformed, then cutting elements 22 may be mounted therein, typically by brazing, in a separate operation after fabrication of the bit. On the other hand, if natural diamonds or polycrystalline synthetic diamonds which can withstand the processing temperatures encountered during fabrication are utilized, the diamonds may be positioned directly in the mold and secured thereto with a conventional adhesive prior to placement of the matrix material into the mold. This latter method eliminates the need for a separate step of mounting the cutting elements after molding of the bit.

The drilling fluid flows downwardly through drill string 13 into the inner portion 17 of the matrix bit crown 14, such fluid passing through exit ports 18 formed integrally in the matrix and having a hardface coating 14' thereon. The drilling fluid from the exit ports discharges from the face of the bit and against o across cutting elements 22. Exit ports 18 may be circular, rectangular, or any other suitable shape in cross-section.

Figure 2:
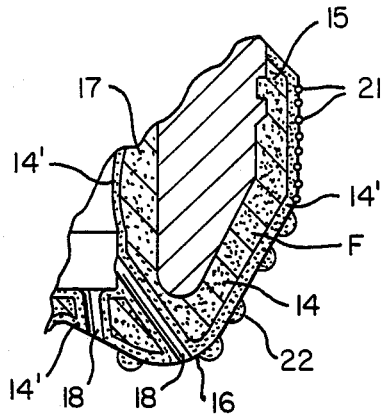
FIG. 2 is a view, similar to FIG. 1, of another embodiment of the invention.

Referring now to FIG. 2, where like reference numerals represent like elements, there is illustrated another embodiment of the invention. As in the embodiment of the invention illustrated in FIG. 1, the FIG. 2 embodiment includes a coating 14' of hardface material which substantially completely covers the inner and outer surfaces of the matrix exposed to fluid flow and/or formation contact. In this embodiment, filler material F is in the form of a powder which is dispersed throughout the inner metal matrix 14. Preferably, the filler material is at least 400 mesh (approx. 0.001 inches) in size. It has been found that very fine powdered materials (i.e., less than 0.001 inches in diameter) such as iron may sinter and shrink during furnacing.

It is undesirable for the bulk volume of the powder to shrink during heat processing. It is desirable that the binder substantially completely infiltrate the filler material and consolidate the matrix, hardface layer, and filler material into a unitary solid mass. Particle sizes smaller than about 400 mesh may be utilized in lesser amounts in admixture with larger particles; this increases the packing efficiency of the particles.

Figure 3:
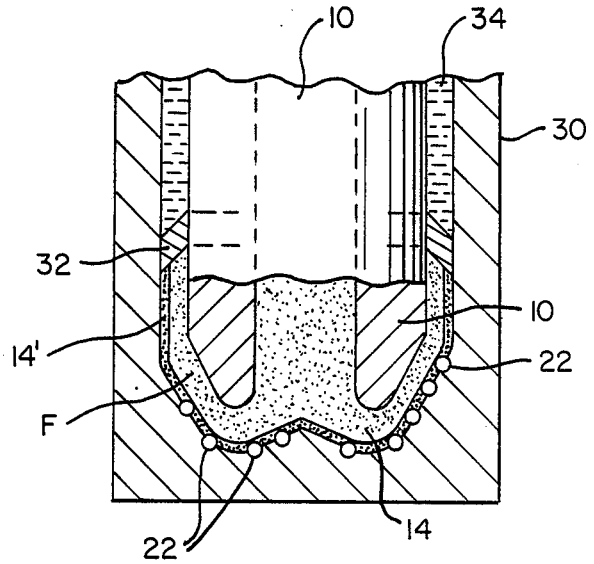
FIG. 3 is a sectional view of a mold for a rotary drill bit in accordance with the present invention, with the mold containing the various materials used to make up the finished bit.

FIG. 3 illustrates a preferred metallurgical process for fabricating the rotary drill bit of the present invention. A hollow mold 30 is provided in the configuration of the bit design. The mold 30 may be of any material, such as graphite, which will withstand the 1000 degrees C. and greater heat processing temperatures.

If natural diamond cutting elements or synthetic polycrystalline diamonds which can withstand the processing temperatures utilized, they are conventionally located on the interior surface of the mold 30 prior to packing the mold. The cutting elements 21 (not shown in FIG. 3) and 22 may be temporarily secured using conventional adhesives which vaporize during heat processing. During infiltration, the cutting elements will become secured in the matrix 14 and abrasion resistant coating 14' during formation of the bit body.

Alternatively, if other types of cutting elements are used, the mold is shaped to produce preformed sockets in matrix 14 and hardface coating 14' to which the cutting elements may be secured after the bit body has been formed. These elements may then be secured by any conventional means such as hard soldering or brazing. Additionally, the cutting elements may be mounted on studs which fit into the sockets, and the studs secured therein.

Because of the high velocity and erosive fluids which are typically encountered by the rotary drill bit, a hardfacing material 14' is then positioned about the periphery of the mold and the displacement elements, commonly sand cast, clay or ceramic parts or inserts (not shown) which will define the internal flow passages, junk slots, cutter mounting recesses, and other features on and within the finished bit. The thickness of the hardface layer may be closely controlled through the use of an adhesive which is applied to the mold and sand casting (or other insert) surfaces followed by placement of the hardfacing material, preferably in powder form. The thickness of the layer is built up by applying additional adhesive and hardfacing material layers sequentially on the mold and sand casting surfaces. In this manner, a substantially uniform layer of hardfacing material may be built up.

Specifically, the adhesive used is a pressure sensitive adhesive which is sprayed onto the mold and displacement element surfaces. Spraying of the adhesive provides close control of the amount utilized and enables the adhesive to reach all recesses in the mold. The pressure sensitive adhesive may be either solvent or water based, although a solvent-based adhesive is preferred because of faster drying times. A suitable solvent-based pressure sensitive adhesive for use in the practice of the present invention is commercially available from 3M Corporation under the designation Fastbond 34.

Build-up of the layer of hardfacing material to a desired thickness may require from 10 to 30 or more sequential applications of adhesive and abrasion resistant material. The hardfacing material is added in powder form to the mold, and the mold rotated or tumbled to distribute evenly the powder. In another preferred application technique, the hardfacing particles may be intermixed with adhesive and sprayed onto the mold surfaces using an air or airless sprayer in much the same manner as a heavily-pigmented paint would be applied to a surface. Alternatively, the adhesive and particles may emanate from separate nozzles and be intermixed in stream prior to contacting the surface to be coated.

Further, the composition of the hardfacing material may be varied from application to application to provide a better transition between the coefficients of thermal expansion or elastic modulus of the outermost hardface material layer and the inner matrix filler material. That is, over the thickness of the layer, increasing amounts of inner matrix filler material may be blended in with the hardfacing material powder. Alternatively, application of successive layers of hardfacing and filler materials may be alternated to provide the transition between hardfacing and matrix. For example, filler may be initially introduced after five applications of hardface material and then gradually more frequently until filler makes up every other application of material. Other combinations and variations of applications of hardface and filler material are also within the scope of the invention. The resulting composite is believed to possess lower initial thermal-induced stresses from furnacing and cooling. Additionally, binder and/or other metals may be introduced into the hardface in layers by these application techniques, in order to alter the characteristics of the hardface from a mechanical, chemical or other standpoint, assure complete infiltration of the hardface, etc.

Because of the need to control closely the thickness of the layer of abrasion resistant material, the need to have a uniform layer on nonhorizontal surfaces, and the need for the abrasion resistant material to adhere to the sharply curved surfaces of the sand cast parts or other mold inserts, prior art procedures such as wet mix packing cannot be used. Wet mix packing of the material refers to a process of mixing the material with a liquid hydrocarbon and packing the material while wet into the mold. It is believed that a wet packed material may not adhere sufficiently to nonhorizontal mold surfaces of the sharply curved surfaces of the sand cast parts in all cases. Further, the presence of relatively larger amounts of liquid hydrocarbon in a wet mix material would result in a more porous layer after heat processing. Finally, wet packing cannot provide a substantially uniform hardfacing thickness.

Hardfacing material 14' (which may include filler, binder, and/or other metals) is preferably applied to a layer thickness of between about 0.10 to about 0.25 inches to all interior surfaces of the mold and around the periphery of the sand cast surfaces. Hardfacing material 14' may be of tungsten carbide, boron nitride, or silicon carbide. As is known in the art, the powder grain size distribution of hardfacing material 14' may be varied to increase the skeletal density of the material, and thus increase its hardness, erosion and abrasion resistance.

After hardfacing material 14' has been placed around the inner face of the mold and on the exterior faces of the displacement elements, the tubular steel blank having blades 10 is partially lowered into the mold as shown. The coated sand cast displacement elements which will form the internal fluid passages and exit parts in the finished bit may also be positioned in the mold at this time prior to blank placement, but are omitted in FIG. 3 for purposes of clarity. However, in some instances, depending upon the complexity of the cast internal fluid passages, it may be possible to mount the elements in the mold and coat them and the mold surfaces in a single procedure. Filler material F is then added. The filler material may be any material which can resist the high processing temperatures encountered. Preferably, the filler material is less expensive than prior art matrix material and also is tougher and more ductile (less brittle). Additionally, filler material F should be compatible with the hardfacing material and binder.

In a preferred embodiment, filler material F is selected from the group consisting of iron, steel, ferrous alloys, nickel, cobalt, manganese, chromium, vanadium, and metal alloys thereof, sand quartz, silica, ceramic materials, plastic-coated minerals, and mixtures thereof. The filler material is preferably in the form of discrete particles, and most preferably is in the form of generally spherical particles. Such spherical particles are easier to pack into the mold. Particle sizes may vary greatly from about 400 mesh (approx. 0.001 inches) to about 0.25 inches in diameter. Particles smaller than about 400 mesh are not preferred because they tend to sinter to themselves and shrink during heat processing. Particles larger than about 0.25 inches are possible, with the upper limit on particle size being that size of particles which can be efficiently packed into mold 30.

Where relatively large particle sizes of filler material F have been used, dry powdered hard metal material may then be poured into the mold and around the filler material. Where relatively small particles of filler material have been used, it may be desirable to premix the filler material F and metal matrix material, if any is used, prior to pouring the mixture into mold 30.

It is desirable to vibrate the mold gently at this point of the process to insure that the powdered matrix material (if any) and filler material particles F are completely packed and interspersed, and that all voids have been filled. This vibration facilitates the pre-furnacing packing between binder, hard metal used in the inner matrix, hardfacing material, and filler material particles, eliminating the potential for voids or vugs.

In a preferred embodiment of the invention, the filler material F comprises from about 50% to about 80% of the total volume of matrix 14. The use of different diameter displacement particles permits more efficient packing of the filler material (the smaller particles occupy the interstices between larger particles) and a greater volume of matrix. In instances where relatively fine filler material particles are employed, the use of a hard metal powder, such as tungsten carbide, in the inner matrix can be eliminated altogether.

In some instances, filler material F will be less dense than the binder 34 which infiltrates it. In such cases, it is preferred that a collar 32 of a dense metal such as tungsten be positioned as shown in FIG. 3 to contain the displacement material. Collar 32 may be formed by pouring a tungsten metal powder over filler material F, of matrix 14 and hardfacing material 14'.

Binder 34, preferably in the form of pellets or other small particles, as well as flux (not shown) is then poured over collar 32 and fills mold 30. The amount of binder 34 utilized should be calculated so that there is a slight excess of binder to completely fill all of the interstices between particles of filler material, hardfacing material. Binder 34 is preferably a copper-based alloy as is conventional in this art.

The mold 30 is then placed in a furnace which is heated to above the melting point of binder 34, typically, about 1100 degrees C. The molten binder passes through powder collar 32 and completely infiltrates filler material F, hard metal of inner matrix 14, and hardfacing layer 14'. The materials are consolidated into a solid body which is bonded to steel blank 10. After cooling, the bit body is removed from the mold, and a portion of collar 32 is machined off. Steel blank 10 is then welded or otherwise secured to an upper body or shank such as a companion pin which is then threaded to box 12 of the lowermost drill collar at the end of drill string 13. Cutting elements 21 and 22, if not previously secured to the bit in the mold, may be mounted at this time.

While it is preferred that filler material F comprise from about 50 to about 80% by volume of the matrix, the use of the hardface coating of the present invention permits complete replacement of the hard prior art matrix material by the filler material except for the exposed surfaces covered by hardface layer 14'. In this embodiment of the invention, filler material F is preferably iron, steel, or alloys thereof. In the furnace, binder 34 will completely infiltrate both filler material F as well as hardface layer 14'. The powder size of filler material D is 400 mesh or greater so that infiltration of the binder will occur without significant shrinkage of the metal powder. However, small amounts of less than 400 mesh powder may be used to fill in interstices between larger particles without encountering any sintering problems.

It has been found that the less expensive filler materials may be substituted for the more expensive metal matrix materials and not cause detrimental shrinkage in the mold. Additionally, when the preferred iron or steel filler material is used, the resulting bit is tougher, less brittle, and more impact resistant than prior hard metal matrix bits. The hardface coating on the exposed surfaces of the bit makes it substantially as erosion and abrasion resistant as prior hard metal matrix bits.

In order that the invention may be more readily understood, reference is made to the following example, which is intended to illustrate the invention, but is not to be taken as limiting the scope thereof.

EXAMPLE

Samples of matrix material containing filler material with exposed surfaces coated with the hardfacing material used in the practice of the present invention were tested for erosion resistance, abrasion resistance, resistance to spalling, and interfacial failure. The test samples were fabricated in accordance with the process described above in a mold which was then furnaced. A tungsten carbide powder having varying particle sizes designed to produce a dense coating was used for the hardfacing layer and a copper-alloy binder was infiltrated into the hardfacing.

Resistance to Erosion

Two samples of hardfacing material with copper-alloy binder were tested for erosion resistance. The samples were first weighed to determine an initial weight. A high velocity slurry of silicon carbide was impinged on each sample for 30 minutes. The samples were then reweighed to determine the volume of material that had been eroded away. Those results were then compared against the weight loss resulting from a sample made of a conventional tungsten carbide hard metal matrix. Sample 1 suffered a volume loss of 0.1833 $cm^3$ while Sample 2 suffered a volume loss of 0.1708 $cm^3$. These volumes were approximately those expected of a conventional tungsten carbide hard metal matrix material.

Resistance to Abrasion

Abrasion tests were performed on two sample having the same composition as the samples above. The tests were generally performed in accordance with procedures detailed for three-body abrasion tests in ASTM Standard G65-81. The tests were performed by subjecting the samples to wear from a series of abrasive wheels for 5000 revolutions each of wheels having 50, 60, and 70 durometer hardnesses using a particulate-laden fluid between the samples and the wheels. Sample 3 experienced a volume loss of 0.0165 $cm^3$ while Sample 4 experienced a volume loss of 0.0145 $cm^3$. The volume losses were approximately those expected of a conventional tungsten carbide hard metal matrix material.

Resistance to Spalling

Resistance to failure at the hardfacing matrix interface was tested by preparing a sample having a filler metal matrix core coated with the hardfacing above. The sample was furnaced and infiltrated by a copper-alloy binder. A disk of the sample material approximately 2 inches in diameter and approximately 0.20 inches thick was compressed across its diameter with flat platens until the diameter had been reduced to approximately 1.5 inches. The sample was then surface ground, lapped, and subjected to optical examination with a metallograph. Only minor evidence of localized delamination was evident in those regions that would have been expected to have experienced the highest degree of stress. The deformation produced by this test was grossly higher than that which could be reasonably expected to be encountered during actual use of a bit in the field. The minor amount of localized delamination indicates that the bond at the abrasion resistant material/hard metal matrix material interface is strong enough to resist any delamination forces which would reasonably be expected to be encountered during operation in the field.

Brazing Test

As diamond cutting elements will be brazed directly into sockets on the bit matrix which are coated with the hardfacing material, brazing tests were conducted to determine whether the bond produced would be sufficient to withstand shearing forces expected to be encountered in use. Three tungsten carbide backings of the type used to support diamond cutters were brazed to sample posts that had been coated with the hardfacing material. A silver braze was used. The three samples were then loaded to failure on an Instron testing machine to determine the ultimate shear strength of the braze. The resulting shear strengths for the three samples were:

Sample 5—33,500 psi
Sample 6—38,750 psi
Sample 7—39,500 psi

These results are somewhat higher than those obtained for braze bond strengths with a conventional tungsten carbide matrix material.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A process for the production of a rotary drill bit matrix coated with a hardfacing layer comprising the steps of:

(a) forming a hollow mold for molding at least a portion of the drill bit;
(b) providing one or more displacement elements corresponding to features to be formed on and within the bit;
(c) applying adhesive and hardfacing material to the interior surfaces of said mold and the exterior surfaces of said displacement elements, said adhesive being effective to hold said hardfacing material in place;
(d) positioning a bit blank at least partially within said mold;
(e) packing said mold with a filler material;
(f) infiltrating said filler material and said hardfacing material on said mold and displacement element with a binder in a furnace to form said bit; and
(g) removing said displacement elements to form said features having a coating of said hardfacing material on the surfaces thereof.

2. The process of claim 1 in which step (c) is repeated to build up the thickness of the layer of hardfacing material.

3. The process of claim 2 in which steps (c) is repeated from 10 to 30 times.

4. The process of claim 1 in which said hardfacing material is mixed with said adhesive prior to application.

5. The process of claim 4 in which the mixture of adhesive and hardfacing material is sprayed onto the interior surfaces of said mold and exterior surfaces of said displacement elements.

6. The process of claim 1 in which said adhesive is applied first, followed by the application of said hardfacing material.

7. The process of claim 1 in which said layer is between about 0.01 to about 0.25 inches thick.

8. The process of claim 4 in which said layer is between about 0.10 to about 0.25 inches thick.

9. The process of claim 1 in which said adhesive is a pressure sensitive adhesive.

10. The process of claim 6 in which said adhesive is selected from the group consisting of solvent-based adhesives and water based adhesives.

11. The process of claim 6 in which said adhesive is sprayed onto said interior surfaces of said mold.

12. The process of claim 6 in which said adhesive is sprayed onto the exterior surfaces of said displacement elements.

13. The process of claim 1 in which said hardfacing material comprises tungsten carbide, boron nitride, or silicon carbide.

14. The process of claim 2 in which increasing amounts of filler material are added to said hardfacing material as step (c) is repeated.

15. The process of claim 2 in which the applications of hardfacing material are alternated with applications of filler material.

16. The process of claim 2 which includes the step of applying a binder along with the applications of hardfacing material.

17. The process of claim 1 in which the thickness of said layer of hardfacing material is substantially uniform.

18. A process for the production of a rotary drill bit coated with a layer of hardfacing material on the exterior surface thereof comprising the steps of:

(a) forming a hollow mold for molding at least a portion of the drill bit;

(b) applying an adhesive and a hardfacing material to the interior surfaces of said mold, said adhesive layer being effective to hold said hardfacing material in place;

(c) repeating step (b) to build up the thickness of the layer of hardfacing material;

(d) positioning a bit blank at least partially within said mold;

(e) packing said mold with a filler material;

(f) infiltrating said filler material and said hardfacing material on said mold with a binder in a furnace to form said bit; and (g) removing said bit surfaced with said hardfacing material from said mold.

19. The process of claim 18 in which the thickness of said layer of hardfacing material is substantially uniform.

20. The process of claim 19 in which step (b) is repeated from 10 to 30 times.

21. The process of claim 18 in which said hardfacing material is mixed with said adhesive prior to application.

22. The process of claim 21 in which the mixture of adhesive and hardfacing material is sprayed onto the interior surfaces of said mold.

23. The process of claim 18 in which said adhesive is applied first, followed by the application of said hardfacing material.

24. The process of claim 18 in which said layer is between about 0.10 to about 0.25 inches thick.

25. The process of claim 18 in which said adhesive is a pressure sensitive adhesive.

26. The process of claim 25 in which said adhesive is selected from the group consisting of solvent-based adhesives and water-based adhesives.

27. The process of claim 23 in which said adhesive is sprayed onto said interior surfaces of said mold.

28. The process of claim 18 in which the applications of hardfacing material are alternated with applications of filler material.

29. The process of claim 18 which includes the step of applying a binder along with the applications of hardfacing material.

30. A process for the production of a layer of hardfacing material on the exterior surfaces of a displacement part comprising the steps of:

(a) applying an adhesive and a hardfacing material to the exterior surfaces of said displacement part, said adhesive being effective to hold said hardfacing material in place; and (b) repeating step (a) to build up the thickness of the layer of hardfacing material.

31. The process of claim 30 in which the thickness of said layer of hardfacing material is substantially uniform.

32. The process of claim 31 in which steps (a) and (b) are repeated from 10 to 30 times.

33. The process of claim 30 in which said hardfacing material is mixed with said adhesive prior to application.

34. The process of claim 33 in which the mixture of adhesive and hardfacing material is sprayed onto the exterior surfaces of said displacement part.

35. The process of claim 30 in which said adhesive is applied first, followed by the application of said hardfacing material.

36. The process of claim 30 in which said layer is between about 0.10 to about 0.25 inches thick.

37. The process of claim 30 in which said adhesive is a pressure sensitive adhesive.

38. The process of claim 37 in which said adhesive is selected from the group consisting of solvent-based adhesives and water-based adhesives.

39. The process of claim 35 in which said adhesive is sprayed onto said exterior surfaces of said displacement part.

40. The process of claim 30 in which the applications of hardfacing material are alternated with applications of filler material.

41. The process of claim 30 which includes the step of applying a binder along with the applications of hardfacing material.

* * * * *